US009822602B2

(12) United States Patent
Bleck et al.

(10) Patent No.: US 9,822,602 B2
(45) Date of Patent: Nov. 21, 2017

(54) BLIND SHEAR RAM

(71) Applicant: Hydril USA Distribution, LLC, Houston, TX (US)

(72) Inventors: Julia Anne Bleck, Houston, TX (US); Brian Scott Baker, Houston, TX (US); Devasish Choudhury, Houston, TX (US); Richard Lee Stringfellow, Houston, TX (US)

(73) Assignee: HYDRIL USA DISTRIBUTION, LLC, Houston, TX (US)

( * ) Notice: Subject to any disclaimer, the term of this patent is extended or adjusted under 35 U.S.C. 154(b) by 378 days.

(21) Appl. No.: 14/508,819

(22) Filed: Oct. 7, 2014

(65) Prior Publication Data

US 2016/0097250 A1 Apr. 7, 2016

(51) Int. Cl.
*E21B 33/06* (2006.01)

(52) U.S. Cl.
CPC ..... *E21B 33/061* (2013.01); *E21B 33/063* (2013.01)

(58) Field of Classification Search
CPC ..... E21B 33/061; E21B 33/063
See application file for complete search history.

(56) References Cited

U.S. PATENT DOCUMENTS

| | | | | |
|---|---|---|---|---|
| 3,561,526 | A | 2/1971 | Williams et al. | |
| 4,240,503 | A | 12/1980 | Holt, Jr. et al. | |
| 4,646,825 | A | 3/1987 | Van Winkle | |
| 5,400,857 | A | 3/1995 | Whitby et al. | |
| 5,515,916 | A | 5/1996 | Haley | |
| 6,158,505 | A | 12/2000 | Araujo | |
| 6,244,336 | B1 | 6/2001 | Kachich | |
| 7,207,382 | B2 | 4/2007 | Schaeper | |
| 8,166,993 | B2 | 5/2012 | Childers | |
| 8,464,785 | B2 | 6/2013 | Carbaugh | |
| 2011/0147623 | A1 | 6/2011 | Hall et al. | |
| 2011/0226476 | A1 | 9/2011 | Springett et al. | |
| 2013/0168075 | A1 * | 7/2013 | Shah | E21B 33/063 166/55 |

FOREIGN PATENT DOCUMENTS

| | | |
|---|---|---|
| CN | 2522614 Y | 11/2002 |
| EP | 2610428 A2 | 7/2013 |

OTHER PUBLICATIONS

PCT Search Report and Written Opinion issued in connection with corresponding Application No. PCT/US2015/05676 dated Nov. 30, 2015.

* cited by examiner

*Primary Examiner* — Caroline N Butcher
(74) *Attorney, Agent, or Firm* — Hogan Lovells US LLP

(57) ABSTRACT

A shear ram assembly for use in a BOP stack. The shear ram assembly includes a ram block disposed within the shear ram housing and having a forward end facing the bore, the ram block movable between an open position, in which the ram block is retracted away from the bore, and a closed position, in which the ram block is extended toward the bore. The blade has a forward surface, a rear surface, a lower shearing edge, and an upper edge, the blade attached to the forward face of the ram block by fasteners extending at an angle relative to an upper surface of the ram block through a portion of the ram block and into the rear surface of the blade, the rear surface of the blade angled so that it is perpendicular to the longitudinal axis of the fasteners.

12 Claims, 6 Drawing Sheets

BLIND SHEAR RAM

BACKGROUND OF THE INVENTION

1. Field of the Invention

This technology relates to oil and gas wells, and in particular to an improved blind shear ram for a blowout preventer (BOP).

2. Brief Description of Related Art

A typical BOP includes a bore that runs through the BOP and connects to a wellbore. Pipe and tools are introduced to the wellbore through the bore in the BOP. Generally, blind shear rams are included in a BOP stack, and are used to shear pipe or tools inside a bore where containment of the pressure within the bore is necessary, such as in a situation where an unexpected pressure surge in the well poses a danger to personnel on a rig or other well site.

Blind shear rams typically include shear ram blocks that are mounted inside a housing, or bonnet, on the BOP. The shear ram blocks have blades that are attached to the front ends thereof, toward the bore. When the shear rams are activated, pistons push the shear ram blocks within the housing, causing the shear ram blocks and blades to close across the bore, simultaneously shearing any pipe, tools, or other objects in the bore and sealing the well. As the shear rams close, the shear ram blocks and blades are exposed to the wellbore pressure, which can be very high, such as more than 15,000 lbs/in$^2$.

Some existing shear ram designs utilize bolts or other fasteners to attach the ram blades to the shear ram blocks. Usually such bolts are passed through the front face of the blade into the block. This can be problematic, however, because drilling holes through the face of the blade for the fastener weakens the blade, and can introduce stress paths. In addition, the positioning of the fasteners on the blade requires staggering of the height of the bolts on the blade, leading to uneven distribution of stresses in the bolts under pressure. As a result, it is common for bolts to fracture at pressures higher than about 15,000 lbs/in$^2$.

In today's oil and gas industry, however, drilling operations are moving into ever deeper water, which causes ever higher pressures in the wellbore. It is not uncommon, for example, for a BOP to sit on top of a well whose pressure is greater than 15,000 lbs/in$^2$, and even up to about 20,000 lbs/in$^2$ or more, thereby exceeding the operational constraints of known BOP blind shear rams.

SUMMARY OF THE INVENTION

Disclosed herein is a shear ram assembly for use in a blow-out preventer (BOP) stack with a shear ram housing and a bore. The bore of the BOP is configured for alignment with a wellbore when the BOP is attached to a wellhead. The shear ram assembly includes a ram block disposed within the shear ram housing and having a forward end facing the bore. The ram block is movable between an open position, in which the ram block is retracted away from the bore, and a closed position, in which the ram block is extended toward the bore.

The ram block assembly also includes a blade having a forward surface, a rear surface, a lower shearing edge, and an upper edge. The blade is attached to the forward end of the ram block by fasteners. In some embodiments, the fasteners may extend at an angle relative to an upper surface of the ram block, through a portion of the ram block, and into the rear surface of the blade. In other embodiments, the fasteners may extend through the blade into the ram block.

In yet further embodiments, the rear surface of the blade may be angled so that it is perpendicular to the longitudinal axis of the fasteners.

Also disclosed herein are alternate embodiments of the technology wherein an upper lip extends from an upper portion of the ram block toward the bore, the upper lip contacting the blade to reduce rotation of the blade relative to the housing as the ram block moves from the open to the closed position, thereby reducing stresses in the fasteners. Furthermore, in other example embodiments, the ram block assembly can include a lower lip extending from a lower portion of the ram block toward the bore, the lip separated from the blade by a gap. A seal can be disposed in the gap between the lower lip and the blade for sealing the interface between the ram block and blade.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE PREFERRED EMBODIMENT

Figure 1:
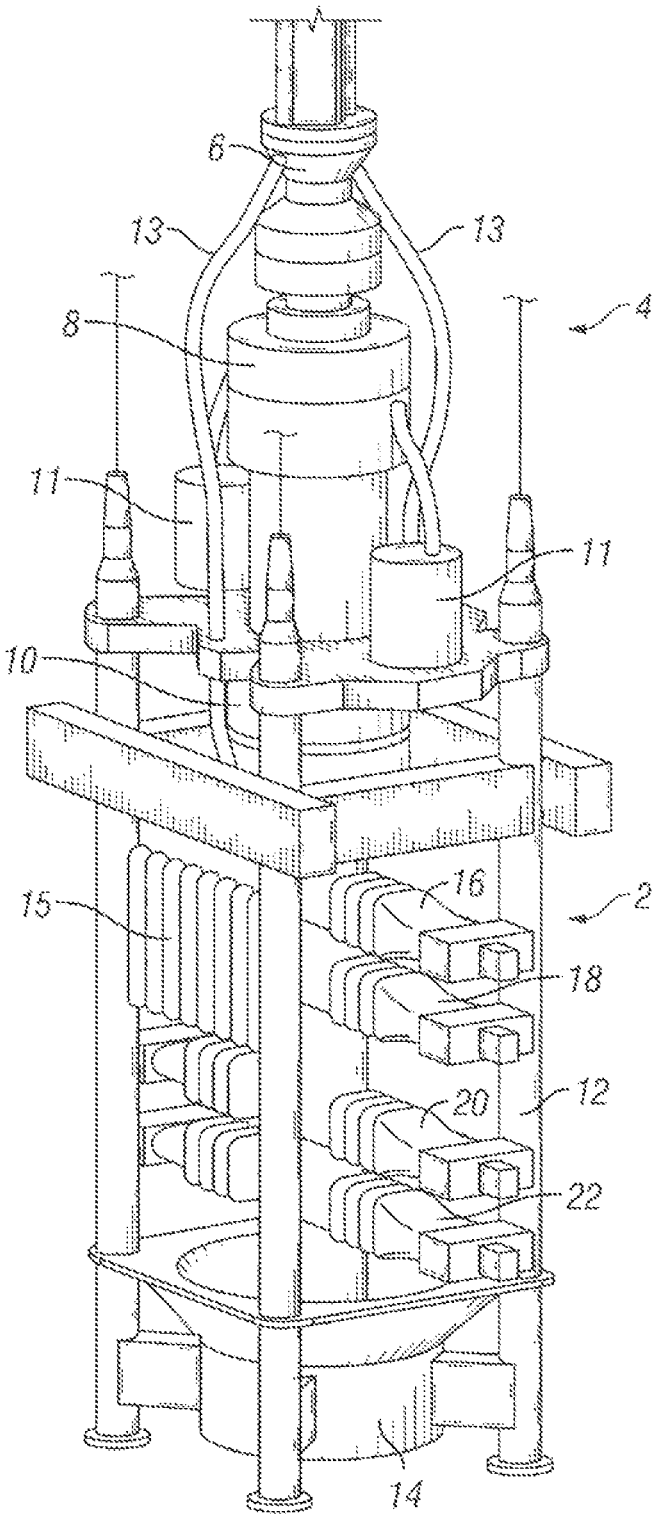
FIG. 1 is a perspective view of a BOP stack assembly attached to a wellhead.

The foregoing aspects, features, and advantages of the present technology will be further appreciated when considered with reference to the following description of preferred embodiments and accompanying drawings, wherein the reference numerals represent like elements. In describing the preferred embodiments of the technology illustrated in the appended drawings, specific terminology will be used for the sake of clarity. However, the technology is not intended to be limited to the specific terms used, and it is to be understood that each specific term includes equivalents that operate in a similar manner to accomplish a similar purpose.

In FIG. 1, there is shown a typical subsea BOP assembly, including a lower stack assembly 2, and an upper stack assembly 4, or lower marine riser package (LMRP). The upper stack assembly 4 can include, for example, a riser adapter 6, annular blowout preventers 8, 10, control pods 11, and choke and kill lines 13. The lower stack assembly 2 can include a frame 12 with a wellhead connector 14 at the lower end for connecting to a subsea wellhead assembly (not shown), as well as hydraulic accumulators 15. Typically, a bore runs through the BOP assembly, including through the upper and lower stack assemblies 2, 4, which bore may contain a pipe. A shear ram housing 16 is normally located above pipe ram housings 18, 20, 22 on the lower stack assembly. The shear ram housing 16 contains shear upper and lower ram blocks 24, 26 attached to upper and lower blades 28, 30 (shown in FIG. 2). Each pipe ram housing 18, 20, 22 contains pipe ram blocks (not shown) with semi-circular recesses on the mating faces for closing around different size ranges of pipe. When open the shear and pipe ram blocks are positioned on either side of the bore. When closed, the shear ram blades 28, 30 seal off the bore. If pipe is present in the bore, the shear ram blades 28, 30 will shear the pipe.

Figure 2:
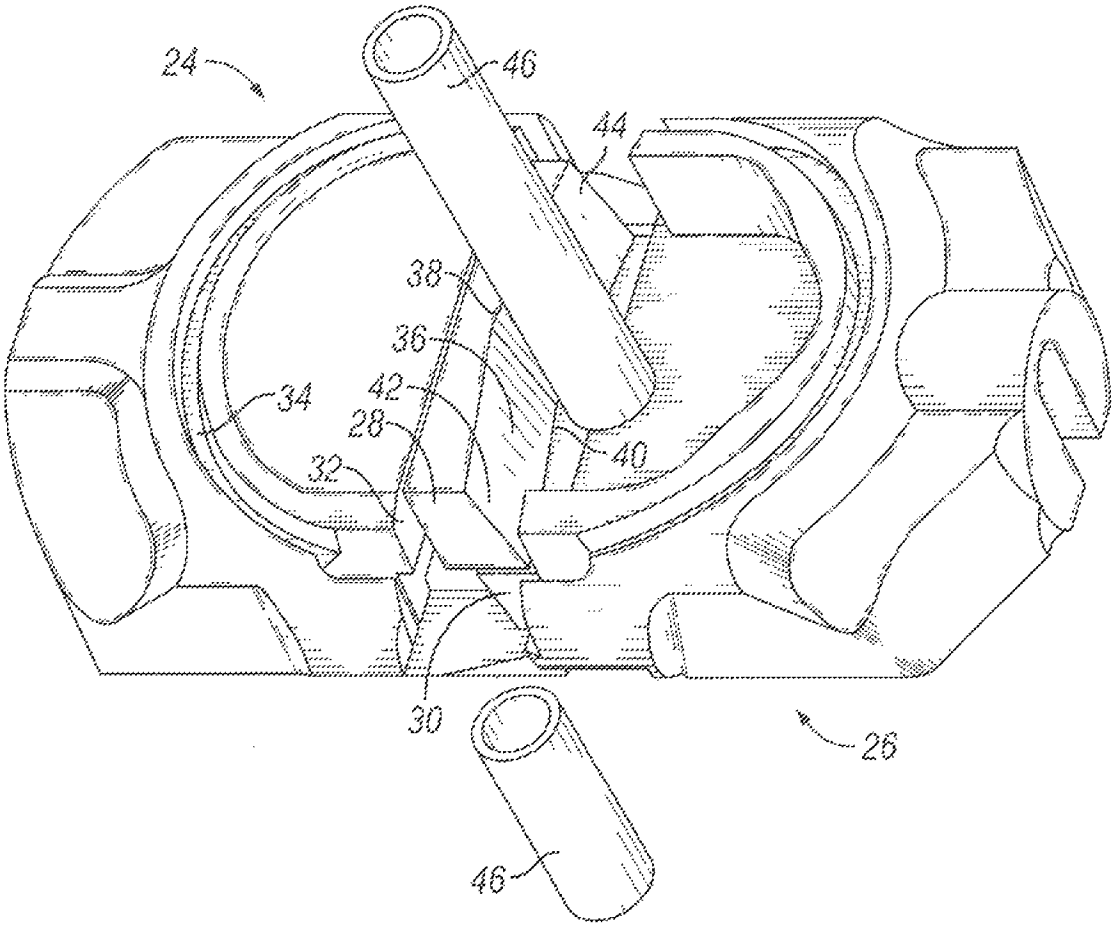
FIG. 2 is a perspective view of upper and lower blind shear rams in a closed position, including a sheared pipe.

Referring now to FIG. 2, there are shown upper and lower shear ram blocks 24, 26 removed from the shear ram housing 16 and in a closed position. The upper shear ram block 24 has a lateral surface that defines a face or forward end 32. The upper blade 28 mounts to the forward end 32 of the upper ram block 24. The upper blade 28 has a forward face 36 with an upper edge 38 and a lower forward edge 40. For purposes of this disclosure, the term forward, with reference to the ram blocks and associated components, shall mean from forward end 32 of upper shear ram block 24 toward the face 36 of the blade 28. In the example shown in FIG. 2, the lower forward edge 40 of the upper blade 28 extends farther forward from the forward end 32 of the upper shear ram block 24 than does upper edge 38. Face 36 of the upper blade 28 may also be generally concave or converging, resulting in the center of face 36 being recessed relative to the more forward portions of the face 36 at outer ends 42, 44. Of course, different shapes for the upper blade 28 may be employed. As can be seen, when the shear ram blocks 24, 26 are closed, the blades 28, 30 overlap, thereby shearing pipe 46 positioned between the ram blocks 24, 26 in the bore of the BOP.

Figure 3A:
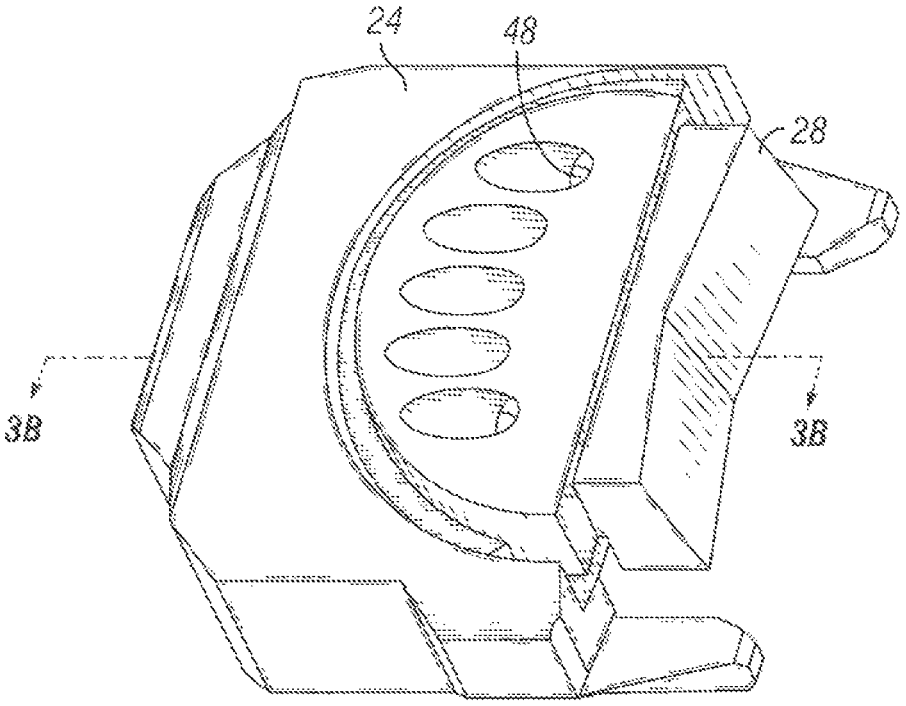
FIG. 3A is a perspective view of a shear ram block and blade according to an embodiment of the present technology.
Figure 3B:
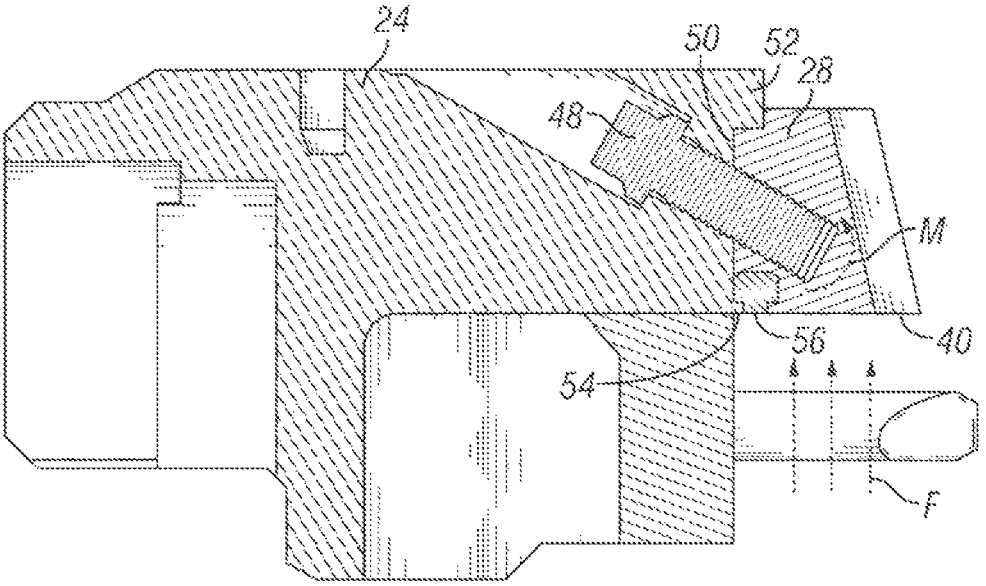
FIG. 3B is a cross-sectional side view of the shear ram block and blade of FIG. 3A taken along line 3B-3B.

Referring to FIGS. 3A and 3B, there is shown a perspective view (FIG. 3A) and a cross-sectional side view (FIG. 3B) of the upper shear ram block 24 and upper blade 28, according to one embodiment of the present technology. To better understand the advantages provided by the present technology, it is useful to understand the forces acting on the upper shear ram block 24 and the blade 28 during the closing of the shear rams. As the upper shear ram block 24 moves forward to close, the fluid below the upper blade 28 exerts an upward force F on the bottom of the upper blade 28, which may be very high, in some instances exceeding 15,000 lbs/in$^2$. This upward force F, and in particular that portion of the upward force F acting at or near the forward edge 40 of the blade 28, causes the blade to rotate away from the upper shear ram block 24, and creates a moment M about the fastener 48 at the interfaces between the upper blade 28 and the upper shear ram block 24. The features of the present technology increase the ability of the upper shear ram block 24 and blade 28 to withstand high pressures by, for example, improving such things as the orientation of the fasteners 48, and the profile of the interface between the ram block 24 and blade 28.

For example, in the embodiment of FIGS. 3A and 3B, the upper blade 28 is attached to the upper shear ram block 24 using a plurality of fasteners 48 that are inserted through the upper surface of the upper shear ram block 24 at an angle and into the upper blade 28 through the back surface 50 of the upper blade 28. Such fastening of the blade 28 to the upper shear ram block 24 through the back surface 50 of the blade is advantageous because it reduces or eliminates the need for fasteners to pass through the face 36 of the blade 28, thereby strengthening the blade 28, and reducing possible stress paths through the blade 28. In FIGS. 3A and 3B, the number of fasteners 48 used to attach the upper blade 28 to the upper shear ram block 24 is five, but more or fewer bolts can be used without departing from the spirit and scope of the present technology. The fasteners may be made from a high strength material, which is not brittle and is not prone to cracking. One advantage to angling the fasteners through the upper shear ram block 24 and into the back of the blade 28 is that the fasteners 48 can engage the back of the blade 28 in the middle or upper portions of the blade 28, where the blade 28 has little contact with pipe being sheared. This reduces the shear forces acting on the fasteners compared to attachment at the lower portion of the blade 28.

Also depicted in FIG. 3B is an upper lip 52 of the upper shear ram 24 that extends forward over a portion of the upper blade 28. This upper lip 52 helps to reduce rotation of the upper blade 28, which rotation may be induced by pressure underneath the blade, as discussed above. The placement of the upper lip 52 above the blade 28 helps to block rotation of the blade 28, thereby reducing the magnitude of the moment M at the fastener 48. This is advantageous because it reduces stresses on the fasteners 48 and the upper blade 28, thereby lowering the likelihood that the fasteners or blade will fracture or bend.

Also depicted in FIGS. 3A and 3B is a lower lip 54 extending from the upper shear ram 24 below the upper blade 28, and a seal 56 positioned between the upper blade 28 and the lower lip 54. As the fasteners 48 are tightened, during attachment of the upper blade 28 to the upper shear ram 24, the upper blade 28 is pulled in toward the lower lip 54, thereby energizing the seal 56 and creating a fight hold on the seal 56.

Figure 4A:
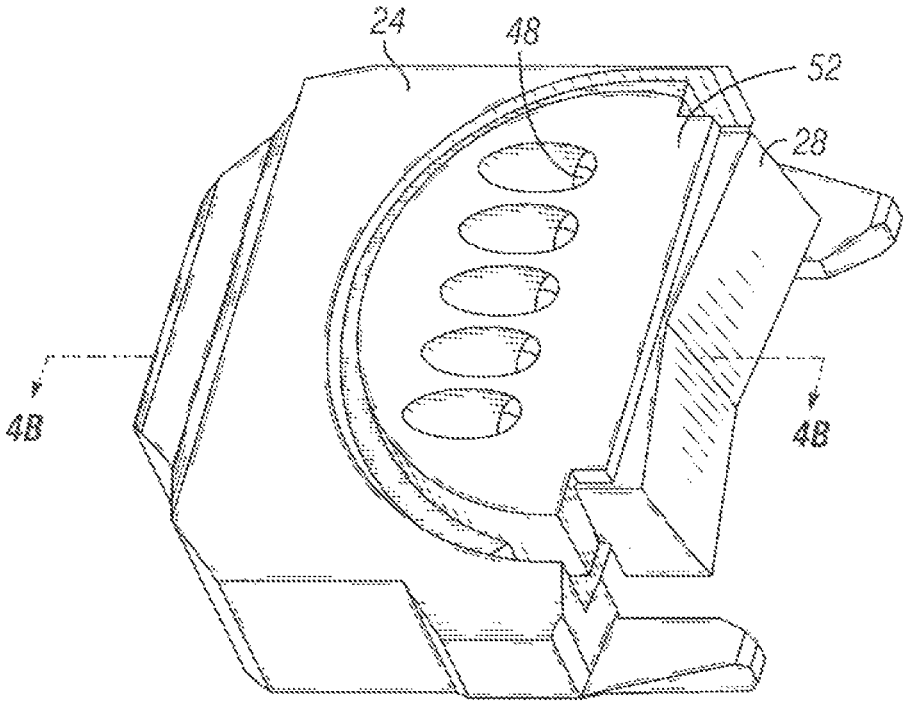
FIG. 4A is a perspective view of a shear ram block and blade according to another embodiment of the present technology.
Figure 4B:
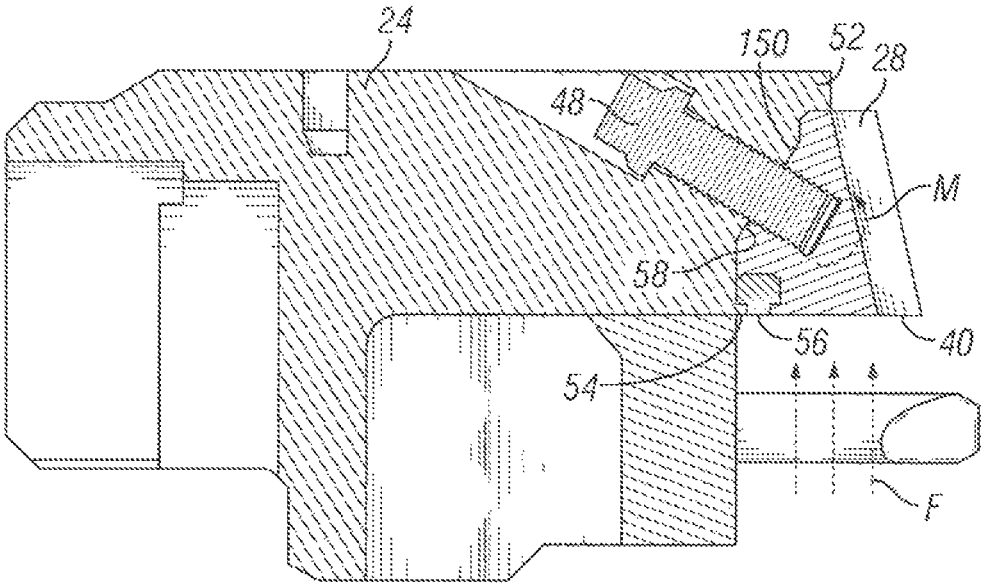
FIG. 4B is a cross-sectional side view of the shear ram block and blade of FIG. 4A taken along line 4B-4B.

FIGS. 4A and 4B show a perspective view (FIG. 4A) and a cross-sectional side view (FIG. 4B) of the upper shear ram block 24 and upper blade 28, according to another embodiment of the present technology. As can be seen, this embodiment includes some similar features to the embodiment of FIGS. 3A and 3B. For example, fasteners 48 are inserted at an angle through the upper shear ram block 24 into the back surface 150 of upper blade 28. Similarly, the upper shear ram block 24 includes an upper lip 52, as well as a lower lip 54 and a seal 56. Each of these features performs functions similar to those described above with respect to FIGS. 3A and 3B, and are advantageous because they allow the upper shear ram block 24 and blade 28 to better withstand high pressure forces F from below the blade 28, especially during closing of the shear rams.

In addition, the embodiment of FIGS. 4A and 4B includes the feature the the back surface 150 of the blade 28 being angled so that it is substantially perpendicular to the longitudinal axis of the fasteners 48. Such an angled back surface 150 of the blade 28 corresponds to a similarly angled surface 58 of the upper shear ram block 24. The angled surface 58 of the upper shear ram block 24 acts in a similar way to the upper lip 52, in that it reduces rotation of the blade 28, thereby further decreasing the moment M that acts on the fastener 48. This is advantageous because it further reduces stresses on the fasteners 48 and the upper blade 28, thereby further lowering the likelihood that the fasteners or blade will fracture or bend.

Figure 5A:
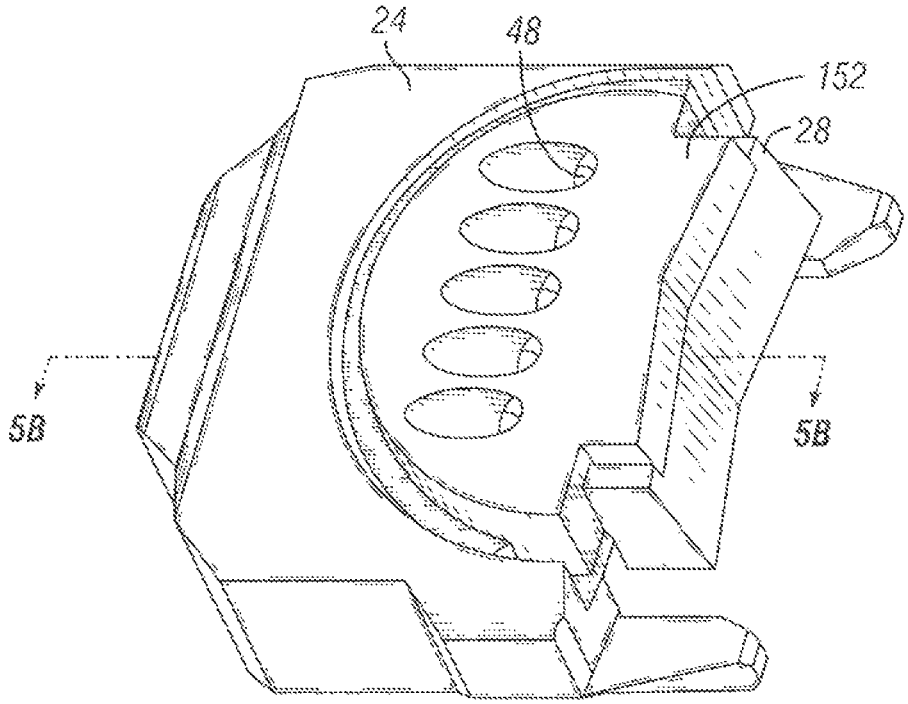
FIG. 5A is a perspective view of a shear ram block and blade according to yet another embodiment of the present technology.
Figure 5B:
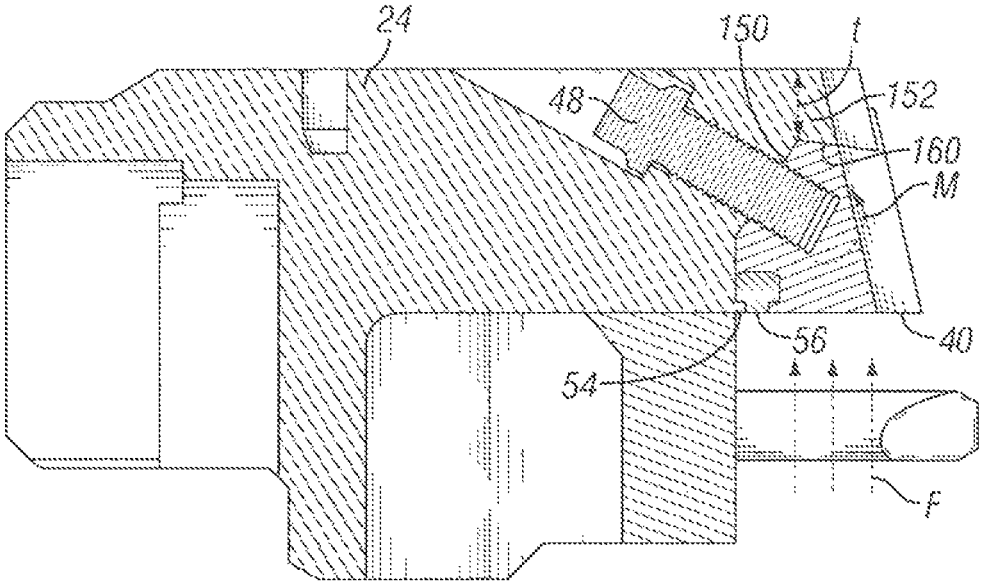
FIG. 5B is a cross-sectional side view of the shear ram block and blade of FIG. 5A taken along line 5B-5B.

FIGS. 5A and 5B show a perspective view (FIG. 5A) and a cross-sectional side view (FIG. 5B) of the upper shear ram block 24 and upper blade 28, according to yet another embodiment of the present technology. As can be seen, this embodiment includes some similar features to the embodiments of FIGS. 3A, 3B, 4A, and 4B. For example, fasteners 48 are inserted at an angle through the upper shear ram block 24 into the back surface 150 of upper blade 28. Similarly, the upper shear ram block 24 includes a lower lip and a seal 56. In addition, the back 150 of the blade 28 is angled so that at least a portion of the back 150 is substantially perpendicular to the longitudinal axis of the fastener 48. Each of these features performs functions similar to those described above with respect to FIGS. 3A, 3B, 4A, and/or 4B, and are advantageous because they allow the upper shear ram block 24 and blade 28 to better withstand high pressure forces F from below the blade 28, especially during closing of the shear rams.

In addition, the embodiment of FIGS. 5A and 5B includes the feature of an upper lip 152 that has greater thickness t than the upper lip 52 of above-described embodiments. In addition, upper lip 152 extends forward about as far as the upper edge 38 of the blade 28, follows the contour of the upper edge 38 of the blade 28, and has a lower surface 160 that slopes forward and downward over a portion of the top of the blade 28. The increased thickness of the upper lip 152, as well as its further extension to the upper edge 38 of the blade 28, help to further limit rotation of the blade 28 relative to the upper shear ram block 24, thereby further reducing the moment on fastener 48, and corresponding stresses in the fastener 48 and blade 28. In addition, the forward and downward sloping lower surface 160 of the upper lip 152 helps to further secure the blade 28 to the upper shear ram block 24, and reduces or eliminates rotation of the blade 28 relative to the ram block 24 in any direction.

Figure 6A:
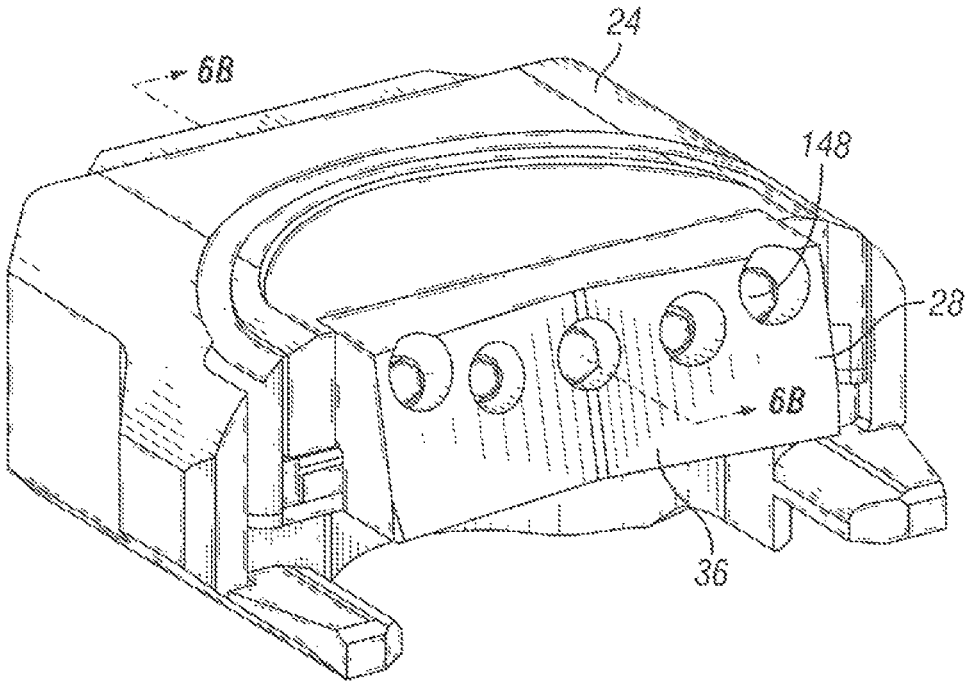
FIG. 6A is a perspective view of a shear ram block and blade according to an alternate embodiment of the present technology.
Figure 6B:
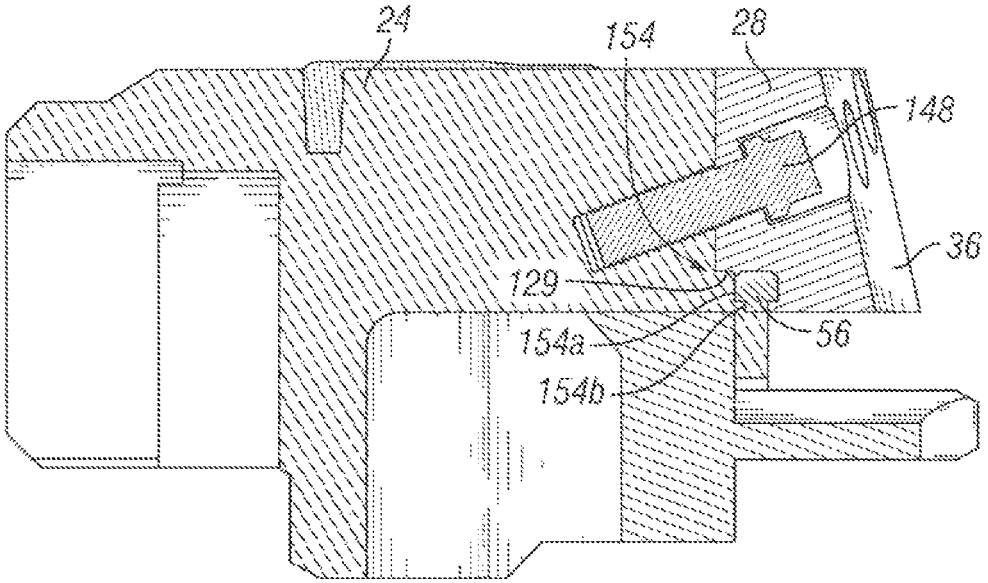
FIG. 6B is a cross-sectional side view of the shear ram block and blade of FIG. 6A taken along line 6B-6B.

FIGS. 6A and 6B show a perspective view (FIG. 6A) and a cross-sectional side view (FIG. 6B) of the upper shear ram block 24 and upper blade 28, according to an alternate embodiment of the present technology. As can be seen, this embodiment includes some similar features to the above-described embodiments. For example, the upper shear ram block 24 includes a lower lip 154 and a seal 156. Each of these features performs junctions similar to those described above with respect to the above-described embodiments, and are advantageous because they allow the upper shear ram block 24 and blade 28 to better withstand high pressure forces F from below the blade 28, especially during closing of the shear rams.

In the embodiment of FIGS. 6A and 6B, the lower lip 154 extends from the upper shear ram 24 below the upper blade 28, and is tiered, having first and second sections 154*a*, 154*b*, respectively, of varying thickness. There is also provided a seal 156 positioned between the upper blade 28 and the lower lip 54. The first portion of the lower lip 154*a* extends forward from the forward face 32 of the upper shear ram block 24, and contacts at least a portion of the bottom 129 of the blade 28. The first portion of the lower lip 154*a* may have a greater thickness than the second portion of the lower lip 154*b*, and provides some resistance to the upward rotation of the blade 28, thereby helping to reduce shear stresses in the fasteners 148. The second portion of the lower lip 154*b* performs a similar function to the lower lip 54 of FIGS. 3A and 3B, that is, to energize the seal 156. Specifically, as the fasteners 148 are tightened, during attachment of the upper blade 28 to the upper shear ram 24, the upper blade 28 is pulled in toward the lower lip 54 (including the second portion of the lower lip 154*b*), thereby energizing the seal 156 and creating a tight hold on the seal 156.

In addition, the placement of the first portion of the lower lip 154*a* against at least a portion of the bottom 129 of the blade 28, as shown, allows for the back of the blade 28 to be set back from the seal 156, thereby reducing the tendency of the seal to extrude up between the ram block 24 and the blade 28. This helps to reduce the possibility of fluid leaking between the upper shear ram block 24 and the blade 28.

FIGS. 6A and 6B also show the fasteners 148 extending through the front face 36 of the blade 28 and into the shear ram block 24. In FIGS. 6A and 6B, five fasteners 148 are shown inserted through the blade 28, but more or fewer fasteners may be used. In addition, in some embodiments, the outer fasteners may be larger than the inner fasteners to compensate for larger pressure forces that may act on outer portions of the blade 28. Such an arrangement may be advantageous as well so that the inner fasteners do not interfere with the shear area of the blade. 28.

In addition, as the fasteners 148 are torqued, the blade 28 clamps toward the lower lip 54, thereby energizing and compressing the seal 56 between the blade 28, the lower lip 54, and the shear ram block 24. As shown, the fasteners 148 may be inserted at an angle relative to the blade 28 so that the holes in the blade 28 are not in the lower section of the blade 28 where shearing occurs, thereby reducing the shear stresses on the fasteners 148. This design reduces stresses on the fasteners 148 and the blade 28, thereby reducing the possibility of fractures.

Each of the features of the present technology, as described and shown in various combination in the above-described embodiments, increase the ability of the shear ram block 24 and blade 28 to withstand wellbore pressures of more than 15,000 lbs/in$^2$ while the shear rams close. In fact, the ram block, and blade designs shown and described herein increase the ability of the shear rams to withstand up to about 20,000 lbs/in$^2$ of pressure or more. In addition, the shear ram assembly of the present technology can withstand up to about 1,900,000 lbs of shearing force when shearing a pipe or other object in the bore.

While the technology has been shown or described in only some of its forms, it should be apparent to those skilled in the art that it is not so limited, but is susceptible to various changes without departing from the scope of the invention. Furthermore, it is to be understood that the above disclosed embodiments are merely illustrative of the principles and applications of the present invention. Accordingly, numerous modifications may be made to the illustrative embodiments and other arrangements may be devised without departing from the spirit and scope of the present invention as defined by the appended claims.

What is claimed is:

1. A shear ram assembly for use in a blow out preventer (BOP) stack with a shear ram housing and a bore, the bore of the BOP configured for alignment with a wellbore when the BOP is attached to a wellhead, the shear ram assembly comprising:

a ram block disposed within the shear ram housing and having a forward end facing the bore, the ram block movable between an open position, in which the ram block is retracted away from the bore, and a closed position, in which the ram block is extended toward the bore; and a blade having a forward surface, a rear surface, a lower shearing edge, and an upper edge, the blade attached to the forward end of the ram block by fasteners extending at an angle relative to an upper surface of the ram block through a portion of the ram block and into the rear surface of the blade, each of the fasteners having a first dimension and a second dimension, the first dimension being larger than the second dimension, the rear surface of the blade angled so that it is perpendicular to the first dimension of each of the fasteners.

2. The shear ram assembly of claim 1, further comprising:

an upper lip extending from an upper portion of the ram block toward the bore, the upper lip contacting the blade to reduce rotation of the blade relative to the housing.

3. The shear ram assembly of claim 2, wherein the upper lip extends substantially the same distance forward from the forward end of the ram block as the upper edge of the blade, and has a lower lip surface that contacts the blade and slopes downwardly over a portion of the blade toward the lower shearing edge of the blade.

4. The shear ram assembly of claim 1, further comprising:

a lower lip extending from a lower portion of the ram block toward the bore, the lower lip separated from the blade by a gap; and a seal disposed in the gap between the lower lip and the blade for sealing the interface between the ram block and blade.

5. A shear ram assembly for use in a blow out preventer (BOP) stack with a shear ram housing and a bore, the bore of the BOP configured for alignment with a wellbore when the BOP is attached to a wellhead, the shear ram assembly comprising:

a ram block disposed within the shear ram housing and having a forward face facing the bore, the ram block movable between an open position, in which the ram block is retracted away from the bore, and a closed position, in which the ram block is extended toward the bore;

a blade having a forward surface, a rear surface, a lower shearing edge, and an upper edge, the blade attached to the forward face of the ram block by fasteners, each of the fasteners having a first dimension and a second dimension, the first dimension being larger than the second dimension, the rear surface of the blade angled so that it is perpendicular to the first dimension of each of the fasteners; and an upper lip extending from an upper portion of the ram block toward the bore, the upper lip contacting the blade.

6. The shear ram assembly of claim 5, wherein the fasteners extend at an angle relative to an upper surface of the ram block through a portion of the ram block and into the rear surface of the blade.

7. The shear ram assembly of claim 6, wherein the fasteners extend into an upper portion of the blade closer to the upper edge than the lower shearing edge of the blade.

8. The shear ram assembly of claim 6, wherein the rear surface of the blade is angled so that it is perpendicular to a longitudinal axis of the fasteners.

9. The shear ram assembly of claim 5, wherein the fasteners extend through the blade and into the forward face of the ram block, the fasteners having variable cross-sectional areas to compensate for larger or smaller shear forces that may act on each fastener depending on its position relative to the blade.

10. The shear ram assembly of claim 9, wherein the fasteners extend through an upper portion of the blade closer to the upper edge than the lower shearing edge of the blade.

11. The shear ram assembly of claim 5, wherein the upper lip extends substantially the same distance forward from the forward face of the ram block as the upper edge of the blade, and has a lower lip surface that contacts the blade and slopes downwardly over a portion of the blade toward the lower shearing edge of the blade.

12. The shear ram assembly of claim 5, further comprising:

a lower lip extending from a lower portion of the ram block toward the bore, the lower lip separated from the blade by a gap; and a seal disposed in the gap between the lower lip and the blade for sealing the interface between the ram block and blade.

* * * * *